US005318715A

United States Patent [19]

Krishnan

[11] Patent Number: 5,318,715

[45] **Date of Patent: * Jun. 7, 1994**

[54] LIQUID AUTOMATIC DISHWASHING COMPOSITION CONTAINING TWO ENZYMES

[75] Inventor: Santhana Krishnan, Monmouth Jct., N.J.

[73] Assignee: Colgate-Palmolive Company, Piscataway, N.J.

[ * ] Notice: The portion of the term of this patent subsequent to Mar. 10, 2009 has been disclaimed.

[21] Appl. No.: 708,570

[22] Filed: May 31, 1991

[51] Int. Cl.[5] ..... C11D 3/06; C11D 3/386; C11D 3/43

[52] U.S. Cl. ..... 252/99; 252/174.12; 252/135; 252/174.21; 252/DIG. 14; 252/DIG. 12

[58] Field of Search ..... 252/174.12, 174.21, 252/DIG. 12, 99, DIG. 14, 135

[56] References Cited

U.S. PATENT DOCUMENTS

| | | | |
|---|---|---|---|
| 4,162,987 | 7/1979 | Maguire et al. | 252/174.12 |
| 4,501,681 | 2/1985 | Groult et al. | 252/174.12 |
| 4,568,476 | 2/1986 | Kielman et al. | 252/99 |
| 4,620,936 | 11/1986 | Kielman et al. | 252/DIG. 12 |
| 4,753,748 | 6/1988 | Laitem et al. | 252/174.12 |
| 4,810,413 | 3/1989 | Pancheri et al. | 252/DIG. 12 |
| 4,900,475 | 2/1990 | Ramachandran | 252/DIG. 12 |
| 4,919,834 | 4/1990 | Chen et al. | 252/559 |
| 4,931,195 | 6/1990 | Cao | 252/174.12 |
| 5,094,771 | 10/1992 | Ahmed | 252/99 |

FOREIGN PATENT DOCUMENTS 2140819 5/1984 United Kingdom .

*Primary Examiner*—Paul Lieberman
*Assistant Examiner*—Kery Fries
*Attorney, Agent, or Firm*—Richard E. Nanfeldt; Robert C. Sullivan; Murray Grill

[57] ABSTRACT

Liquid automatic dishwashing compositions containing a binary mixture of Maxacal enzyme and Maxamyl enzyme have been found to be very useful in the removal of protein and carbohydrate soils from dishware at normal dishwasher operating temperatures.

6 Claims, No Drawings

LIQUID AUTOMATIC DISHWASHING COMPOSITION CONTAINING TWO ENZYMES

Field OF THE INVENTION

This invention relates to an improved nonaqueous liquid dishwashing detergent for automatic dishwashing machines. More particularly, this invention relates to a concentrated nonaqueous dishwashing composition which contains enzymes that can function at low alkalinity and high operating temperatures.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability is the property whereby the detergent composition containing enzymes does not undergo any significant degradation during storage. This is also known as shelf life. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a suitable environment, the enzymes will suffer a degradation during storage which will result in a product that will have a decreased initial activity. When enzymes are a part of the detergent composition, it has been found-that the initial free water content of the composition should be as low a level as possible, and this low water content must be maintained during storage, since water will activate the enzymes. This activation will cause a decrease in the initial activity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied since there will be a greater volume of air in contact with the detergent, and thus more available moisture to be absorbed by the detergent composition. This will usually accelerate the decrease in the activity of the detergent composition. The most efficient way to prevent a significant decrease in this activity is to start with an initial high activity of enzyme and to use components in the dishwashing composition which have a low hygroscopicity and a low alkalinity which will minimize any losses in activity as the detergent is being stored or used.

The stability of enzymes in a nonaqueous liquid detergent can be improved by using an alkali metal silicate. In addition, the individual components of the detergent composition should each have an initial free water content (unbounded water at 100° C.) of less than about 10 percent by weight, more preferably less than about 9 percent by weight, and most preferably less than about 8 percent by weight. During manufacture the detergent composition may take-up moisture from the atmosphere. As a result, the moisture content of the detergent composition as it is being packaged may be greater than about 1 percent by weight, preferably less than about 4 percent by weight and most preferably less than about 3 percent by weight.

Nonaqueous liquid dishwasher detergent compositions which contain enzymes can be made more stable and to have a high activity, if the initial free water content of the detergent composition less than about 6 percent by weight, more preferably less than about 4 percent by weight and most preferably less than about 3 percent by weight. A key aspect is to keep the water (non-chemically bonded water) in the detergent composition at a minimum. It is critical that water not be added to the composition. Absorbed and absorbed water are two types of water and comprise the usual free water bound in the detergent composition. Free water will have the affect of deactivating the enzymes. Furthermore, the pH of 1.0 weight % of an aqueous solution of a liquid detergent composition must be less than about 11.0 more preferably less than about 10.8, and most preferably less than about 10.5. This low alkalinity of the dishwashing detergent will also increase the stability of the detergent composition which contains a mixture of enzymes, thereby providing a higher initial activity of the mixture of the enzymes and the maintenance of this initial high activity.

The free water content of the dishwashing detergent compositions of the instant invention can be controlled to a large extent by using components that have a low initial water content and a low hygroscopicity. The individual components of the instant composition should have a water content of less than about 10 percent by weight, more preferably less than about 9 percent by weight, and most preferably less than about 8 percent by weight. In addition, the organic components of the dishwashing detergent composition should have low hydroxyl group content to decrease the hydrogen bonding absorption of water. In place of the carrier such as ethylene glycols or glycerols, relatively low hydroxyl content-anhydrous organics such as alcohol ethers and polyalkylene glycols can be used. In place of polyacid suspending agents normally used in liquid automatic dishwashing detergent compositions such as polyacrylic acid or salts of polyacrylic acids, there should be used polyacid/acid anhydride copolymers such as polyacrylic acid/acid anhydride copolymers. Maleic anhydride is a suitable acid anhydride. The net result is a decreased hydroxyl group content which translates to a decreased hygroscopicity of the detergent composition which helps maintain the stability and the activity.

SUMMARY OF THE INVENTION

This invention is directed to producing a nonaqueous liquid enzyme containing automatic dishwashing detergent compositions which have an increased chemical stability and essentially a constant activity at wash operating temperatures of about 100° F. to about 140° F. This is accomplished by controlling the alkalinity and the hygroscopicity of the detergent composition and using a novel mixture of enzymes. An alkali metal silicate is used in the dishwashing detergent compositions which may have a free water content of less than about 6 percent by weight, more preferably less than about 4 percent by weight, and most preferably less than about 3 percent by weight throughout its usage. The $Na_2O$:-$SiO_2$ ratio can exceed 1:3.22 but should not be lower than about 1:2. In order to achieve this low free water content, the water content of each of the detergent components should be less than about 1 percent by weight, more preferably less than about 0.75 percent by weight, and most preferably less than about 0.5 percent by weight. Furthermore, each of the organic components should have a low hydroxyl group content in order to decrease the potential amount of hydrogen bonded water in the composition.

Conventional automatic dishwashing compositions usually contain a low foaming surface-active agent, a carrier solvent which is usually water, a chlorine bleach, alkaline builder materials, and usually minor ingredients and additives. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces. No surfactant system currently known is capable of adequately performing this function.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation can occur when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al teaches a detergent composition for cleaning dishes, with a pH of from 7 to 9 containing an amylolytic enzyme, and in addition, optionally a proteolytic enzyme.

U.S. Pat. No. 4,101,457 to Place et al teaches the use of a proteolytic enzyme having a maximum activity at a pH of 12 in an automatic dishwashing U.S. Pat. No. 4,162,987 to Maguire et al teaches a granular or automatic dishwashing detergent which uses a proteolytic enzyme having a maximum activity at a pH of 12 as well as an amylolytic enzyme having a maximum activity at a pH of 8.

U.S. Pat. No. 3,827,938 to Aunstrup et al, discloses specific proteolytic enzymes which exhibit high enzymatic activities in highly alkaline systems. Similar disclosures are found in British Patent Specification No. 1,361,386, to Novo Terapeutisk Laboratorium A/S. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent about how to formulate an effective bleach-free automatic dishwashing compositions capable of providing superior performance at low alkalinity levels during conventional use.

U.S. Pat. Nos. 3,840,480; 4,568,476; 3,821,118 and 4,501,681 teach the use of enzymes in automatic dishwashing detergents.

The aforementioned prior art fails to provide a liquid automatic dishwashing detergent which contains a mixture of enzymes for the simultaneous degradation of both proteins and starches, wherein the combination of enzymes have a maximum activity at a pH of less than 11.0 and the liquid automatic dishwashing detergent has optimized cleaning performance in a temperature range of about 100° F. to about 140° F.

It is an object of this invention to incorporate a unique enzyme mixture of proteolytic and amylolytic enzymes in dishwasher detergent compositions which can be used in automatic dishwashing operations capable of providing at least equal or better performance at operating temperatures of about 100° F. to about 140° F.

Both protein soils and carbohydrate soils are extremely difficult to remove form dishware. The use of bleach in automatic dishwashing compositions helps in the removal of protein soils and high alkalinity of these automatic dishwashing compositions helps in the removal of carbohydrate soils, but even with bleach and high alkalinity these protein and carbohydrate soils are not completely removed. The use of a protease enzyme in the automatic dishwashing compositions improves the removal of protein soils such as egg and milk from dishware and the use of an amylase enzyme improves the removal of carbohydrate soils such as starch from dishware.

DETAILED DESCRIPTION

The present invention relates to a nonaqueous liquid automatic dishwashing detergent compositions which comprise a nonionic surfactant, a nonaqueous liquid carrier, sodium silicate, a metal inorganic builder salt and a mixture of an amylase enzyme such as Maxamyl CX 5000 and a protease enzyme such as Maxacal P400,000 and, optionally, a detergent active material such as a nonionic surfactant, a foam depressant, and a lipase enzyme wherein the nonaqueous liquid automatic dishwashing detergent composition has a pH of less than 10.5 and the dishwashing detergent composition exhibits maximum cleaning efficiency for both proteins and starches at a wash temperature of about 100° F. to about 140° F.

The liquid nonionic surfactants that can be, optionally, used in the present nonaqueous liquid automatic dishwasher detergent compositions are well known. A wide variety of the these surfactants can be used.

The nonionic synthetic organic detergents are generally described as ethoxylated propoxylated fatty alcohols which are low-foaming surfactants and are possibly capped, characterized by the presence of an organic hydrophobic group and an organic hydrophilic group and are typically produced by the condensation of an organic aliphatic or alkyl aromatic hydrophobic compound with ethylene oxide and/or propylene oxide. Practically any hydrophobic compound having a carboxyl, hydroxy and amido or amino group with a free hydrogen attached to the nitrogen can be condensed with ethylene oxide or with the polyhydration product thereof, polyethylene glycol, to form a nonionic detergent. The length of the hydrophilic or polyoxy ethylene/propylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low foaming poly-lower alkoxylated lipophiles, wherein the-desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms and which contain from 5 to 8 or 5 to 9 lower alkoxy groups per mole. Preferably, the lower alkoxy is ethoxy but in some instances, it may be desirably mixed with propoxy, the latter, if present, usually being minor (no more than 50%) portion. Exemplary of such compounds are those wherein the alkanol is of 12 to 15 carbon atoms and which contain about 7 ethylene oxide groups per mole.

Useful nonionics are represented by the low foaming Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A (a $C_{13}$–$C_{15}$ fatty alcohol condensed with 6 moles ethylene oxide and 3 moles propylene oxide), Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylen oxide). A particularly good surfactant is Plurafac 132 which is a capped nonionic surfactant. Another group of low foam liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide.

Another liquid nonionic surfactant that can be used is sold under the tradename Lutensol SC 9713.

Synperonic nonionic surfactant such as Synperonic LF D25 or LA RA30 are especially preferred nonionic surfactants that can be used in the nonaqueous liquid automatic dishwasher detergent compositions of the instant invention. Other useful nonionic surfactants are Synperonic RA30, Synperonic RA 40 and Synperonic RA 340. The Synperonic surfactants are especially preferred because they are biodegradable and low foaming Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface, tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7, Tergitol MDS-2 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted. Another useful surfactant is Tergitol MDS-42 a mixed ethoxylation product of 13–15 cations alcohols with 10 moles of EO and 5 moles of PO.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The alkyl polysaccharides surfactants, which are used alone in conjunction with the aforementioned surfactant and have a hydrophobic group containing from about 8 to about 20 carbon atoms, preferably from about 10 to about 16 carbon atoms, most preferably from 12 to 14 carbon atoms, and polysaccharide hydrophilic group containing from about 1.5 to about 10, preferably from 1.5 to 4, most preferably from 1.6 to 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than 10, alkoxide moieties.

Suitable alkyl polysaccharides are decyl, dodecyl, tetradecyl, pentadecyl, hexadecyl, and octadecyl, di-, tri-, tetra-, penta- and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl1 groups contain from about 10 to about 18, preferably from 12 to 14 carbon atoms; n is 2 or 3 preferably 2, r is from 0 to about 10, preferable 0; and x is from-1.5 to about 8, preferably from 1.5 to 4, most preferably from 1.6 to 2.7. To prepare these compounds a long chain alcohol ($R^2OH$) can be reacted with glucose, in the presence of an acid catalyst to form the desired glucoside. Alternatively the alkyl polyglucosides can be prepared by a two step procedure in which a short chain alcohol ($R_1OH$) an be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R^2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG 25 is a nonionic alkyl polyglycoside characterized by the formula:

$$C_nH_{2n+1}O(C_6H_{10}O_5)_xH$$

wherein n=10 (2%); n=12 (65%); n=14 (21-28%:); n=16 (4-8%) and n=18 (0.5%) and x (degree of polymerization) =1.6. APG 625 has: a pH of 6-8 (10% of APG 625 in distilled water); a specific gravity at 25° C. of 1.1 g/ml; a density at 25° C. of 9.1 lbs/gallon; a calculated HLB of about 12.1 and a Brookfield viscosity at 35° C., 21 spindle, 5-10 RPM of about 3,000 to about 7,000 cps.

Mixtures of two or more of the liquid nonionic surfactants can be used and in some cases advantages can be obtained by the use of such mixtures.

The nonaqueous liquid nonionic surfactant has dispersed therein fine particles or organic and/or inorganic detergent builders. A preferred. solid builder salt is an alkali metal polyphosphate such as sodium tripolyphosphate ("TPP"). In place of all or part of the alkali metal polyphosphate one or more other detergent builder salts can be used. Suitable other builder salts are alkali metal carbonates, borates, phosphates, bicarbonates, silicates, lower polycarboxylic acid salts, and polyacrylates, polymaleic anhydrides and copolymers of polyacrylates and polymaleic anhydrides and polyacetal carboxylates.

Specific examples of such builders are sodium carbonate, potassium carbonate, sodium tetraborate, sodium pyrophosphate, sodium tripolyphosphate, potassium tripolyphosphate, potassium pyrophosphate, sodium bicarbonate, sodium hexametaphosphate, sodium sesquicarbonate, sodium mono and diorthophosphate, and potassium bicarbonate. The builder salts can be used alone with-the nonionic surfactant or in an admixture with other builders. Typical builders also include those disclosed in U.S. Pat. Nos. 4,316,812, 4,264,466 and 3,630,929 and those disclosed in U.S. Pat. Nos. 4,144,226, 4,135,092 and 4,146,495, all of which are herein incorporated by reference.

A preferred builder salt is sodium tripolyphosphate (TPP). The TPP is a blend of anhydrous TPP and a small amount of TPP hexahydrate such that the chemically bound water content corresponds to about one $H_2O$ per pentasodium tripolyphosphate molecule. Such TPP may be produced by treating anhydrous TPP with a limited amount of water. The presence of the hexahydrate slows down the rapid rate of solution of the TPP in the wash bath and inhibits caking. One suitable TPP is sold under the name Thermphos NW. The particles size of the Thermphos NW TPP, as supplied, is usually averages about 200 microns with the largest particles being about 400 microns.

The alkali metal silicates are useful builder salts which also function to make the composition anti-corrosive so that damage to eating utensils and to automatic dishwashing machine parts is minimized. Sodium silicates of $Na_2O/SiO_2$ ratios of from 1:1 to 1:2.4 especially about 1:2 to 1:3 are preferred. Potassium silicates of the same ratios can also be used. The preferred alkali metal silicates are sodium disilicate and sodium metasilicate.

Another class of builders useful herein are the water insoluble aluminosilicates, both of the crystalline and amorphous type. Various crystalline zeolites (i.e. alumino-silicates) are described in British Patent No. 1,504,168, U.S. Pat. No. 4,409,136 and Canadian Patent Nos. 1,072,835 and 1,087,477. An example of amorphous zeolites useful herein can be found in Belgium Patent No. 835,351. The zeolites generally have the formula $$(M_2O)_z(Al_2O_3)_y(SiO_2)_x\ wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

In conjunction with the builder salt are optionally used a low molecular weight polyacrylates which have a molecular weight of about 1,000 to about 100,000 more preferably about 2,000 to about 80,000. A low molecular weight polyacrylate is Sokalan TM CP45 manufactured by BASF and having a molecular weight of about 4,500 is useful. Another preferred low molecular weight polyacrylate is Acrysol TM 45ND manufactured by Rohm and Haas and having a molecular weight of about 45,000. A suitable suspending and anti-redepositing agent consists of a copolymer of a polyacid and an acid anhydride. Such a material should have a water absorption at 38° C. and 78 percent relative humidity of less than about 40 percent and preferably less than about 30 percent. The builder is commercially available under the tradename of Sokalan CP 45. This is a partially neutralized copolymer of acrylic acid and maleic acid sodium salt. This suspending and anti-deposition agent also serves to inhibit encrustation, i.e. inhibits the formulation and precipitation of dicalcium phosphate. This suspending agent has a low hygroscopicity as a result of a decreased hydroxyl group content. An objective is to use suspending and anti-redeposition agents that have a low-hygroscopicity. Copolymerized polyacids have this property, and particularly when partially neutralized. Acusol TM 640 ND provided by Rohm & Haas is another useful suspending agent. An especially preferred low molecular non-crosslinked polymer is sodium methacrylate such as Alcospere 124D from Alco Chemical Corp. which was a molecular weight of 6,000 to about 9,000. Other builder salts which can be mixed with the sodium carbonate are gluconates and nitriloacetic acid salts.

The stability against settling properties can be improved by the addition to the composition of a small effective amount of phosphoric ester and the viscosity and anti-gel properties of the composition can be improved by adding to the composition an effective amount of an alkylene glycol monoalkyl ether.

In accordance with an embodiment of the present invention the stability of the suspension is increased by including in the composition an acidic organic phosphorus compound having an acidic-POH group. The use of organic phosphoric acid esters as stabilizing additives to nonionic laundry detergent compositions containing polyphosphate builders is well known.

The acidic organic phosphorus compound may be, for instance, a partial ester of phosphoric acid and an alcohol such as an alkanol which has a lipophilic character, having, for instance, more than 5 carbon. atoms, e.g. 8 to 20 carbon atoms. A specific example is a partial ester of phosphoric acid and a $C_{16}$ to $C_{18}$ alkanol (Empiphos 5632 from Marchon); it is made up of about 35% monoester and 65% diester. The inclusion of quite small amounts of the acidic organic phosphorus compound makes the suspension significantly more stable against settling on standing but remains pourable and decreases its plastic viscosity. It is believed that the use of the acidic phosphorus compound may result in the formation of a high energy physical bond between the —POH portion of the molecule and the surfaces of the inorganic polyphosphate builder so that these surfaces take on an organic character and become more compatible with the nonionic surfactant.

The thickening agents that can be used are those that will swell and develop thixotropic properties in a nonaqueous environment. These include organic polymeric materials and inorganic and organic modified clays. Essentially, any clay can be used as long as it will swell in a nonaqueous medium and develop thixotropic properties. A preferred clay is bentonite organoclay. A swelling agent is used with the bentonite clay. The preferred swelling agent is a combination of propylene carbonate and tripropylene glycol methyl ether. However, any other substance that will cause bentonite to swell in a nonaqueous environment and thus develop thixotropic properties can be used.

Suitable polymeric thickening agents are polycarboxylate polymers such as Carbopol polymers manufactured by B. F. Goodrich. Carbopol 614 and Carbopol 617 are especially preferred polymeric thickening agents. Another class of suitable thickening agents are silicas such as Cab-O-Sil which are useful at a concentration of about 0.1 to about 3.0 weight percent. Another class of thickening agents are polyacrylates having a molecular weight of about 1,000 to about 50,000. An especially preferred polyacrylate is Sokalan CP 45, manufactured by BASF and Acrysol TM 45ND manufactured by Rohm Haas. These polyacrylates are used at a concentration level of about 0.1 to about, 10 weight percent.

Other polymeric thickening agents are low molecular weight associative thickeners such as Dapral(®) T210 and T212 from AKZO chemicals. Dapral T210 and T212 are low molecular weight dialkyl polyglycol ethers with an average molecular weight of about 8000. They are liquids and soluble and compatible in nonaqueous media. Specially preferred is Dapral T210 in 1-5% and in combination with other thickening agents, such as colloidal silica.

Essentially, any compatible anti-foaming agent can be-used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, dimethyl silanated silica, trimethysilanated silica and triethylsilanated silica. Suitable anti-foam agents are Silicone L7604 and DB-100. Other suitable anti-foaming agents are Selecore DB 700 used at about 0.2 to about 1.0 weight %, sodium stearate used at a concentration and of about 0.5 to 1.0 weight %. Another class-of suitable foam depressants used at concentration levels of about 0 to 1.5 weight %, more preferably 0.2 to 1.0 weight %. are the alkyl phosphoric acid esters of the formula

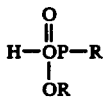

available from BASF-Wyandotte and the alkyl phosphate esters of the formula

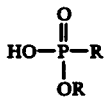

available from Hooker (SAP) and Knapsack (LPKn-158) in which one or both R groups in each type of ester may be represented independently by a alkyl or ethoxylated alkyl group. An especially preferred anti-foaming agent is Silicone 144 from Dow Chemical.

The perfumes that can be used include lemon perfume and other natural scents. Essentially, any opacifier pigment that is compatible with the remaining components of the detergent formulation can be used. A useful and preferred opacifier is titanium dioxide.

The nonaqueous carrier materials that can be used for the liquid automatic dishwashing detergent compositions are contained in the composition at a concentration level of at least about 40 wt. % to about 65 wt. %, more preferably at least 45 wt. % to 60 wt. %, are those that have a low hydroscopicity. These include the higher glycols, polyglycols, polyoxides and glycol ethers. Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (DM), dipropylene glycol methyl ether (DPMI), propylene glycol methyl acetate (PMA), dipropylene glycol methyl ether acetate (DPMA), ethylene glycol n-butyl ether and ethylene glycol dipropyl ether. A preferred nonaqueous carrier of the instant invention is polyethylene glycol 200 or polyethylene glycol 300.

Other useful solvents are ethylene oxide/propylene oxide, propylene oxide liquid random copolymer such as Synalox solvent series from Dow Chemical (Synalox 50-50B). Other suitable solvents are propylene glycol ethers such as PnB, DPnB and TPnB (propylene glycol mono n-butyl ether, dipropylene glycol and tripropylene glycol mono n-butyl ether, dipropylene glycol and tripropylene glycol mono n-butyl ethers sold by Dow Chemical under the tradename Dowanol. Also tripropylene glycol mono methyl ether "TPM Dowanol" from Dow Chemical is suitable. Another useful series of solvents are supplied by CCA biochem b.u. of Holland such as Plurasolv ®ML, Plurasolv ®EL(S), Plurasolv ®EL, Plurasolv ®IPL and Plurasolv ®BL.

Mixtures of PEG solvent with Synalox or PnB, DPnB, TPnB and TPM solvents are also useful. Preferred mixtures are PEG 300/Synalox 50-50B and PEG 300/TPnB in weight ratios of about 95:5 to 50:50. EP/PO capped nonionic surfactants can be used as a liquid solvent carrier and an example of such a nonionic surfactant is Plurafac LF 132 sold by BASF.

The stabilizing system of the instant compositions comprise a finely divided silica such as Cab-O-Sil M5, PTG or Aerosil 200 which are used at a concentration level of about 0 to about 4.0 weight percent, more preferably about 0.5 to about 3.0 weight %. Also employed as a stabilizing system are mixtures of finely divided silica such as Cab-O-Sil, and nonionic associative thickeners such as Dapral T210, T212 (Akzo) which are low molecular weight dialkyl polyglycol ethers with a dumbbell-like structure or Pluracol TH 916 and TH 922 (BASF) associative thickeners having star-like structure with a hydrophilic core and hydrophobic tail. These thickeners are used at concentration levels of about 0 to about 5.0 weight percent together with about 0 to about 2.0 weight percent of finely divided silica. Other useful stabilizing systems are blends of organoclay and hydroxypropyl cellulose polymer (HPC). A suitable organoclay is Bentone NL27 gel sold by NL Chemical. A suitable cellulose polymer is Klucel M Cellulose having a molecular weight of about 1,000,000 and is sold by Aqualon Company. Bentone gel contains 9% Bentone NL 27 powder (100 percent active), 88 percent TPM solvent (tripropylene glycol mono methyl ether) and 3 percent propylene carbonate (polar additive). The organic modified clay thickeners are used at concentration levels of about 0 weight percent to about 15 weight percent in conjunction with Klucel M at concentration levels of about 0 to about 0.5 weight percent, more preferably about 0.2 weight percent to about 0.4 weight percent. Another useful thickening agent is a high molecular weight long chain fatty alcohol ($C_{20}$-$C_{40}$) such as Unilin TM 425 sold by Petrolite chemicals.

A key aspect is to keep the free water (non-chemically bounded water) in the detergent composition at a minimum. Absorbed and adsorbed water are two types of free water, and comprise the usual free water found in a detergent composition. Free water will have the affect of deactivating the enzymes.

The detergent composition of the present invention can possibly include a peroxygen bleaching agent at a concentration of about 2 to about 15 wt. %. The oxygen bleaching agents that can be used are alkali metal perborate, perphthalic acid, percarbonate and perphosphates, and potassium monopersulfate. A preferred compound is sodium perborate monohydrate. The peroxygen bleaching compound is preferably used in admixture with an activator thereof. Suitable activators are those disclosed in U.S. Pat. No. 4,264,466 or in column 1 of U.S. Pat. No. 4,430,244, both of which are herein incorporated by reference. Polyacylated compounds are preferred activators. Suitable preferred activators are tetraacetyl ethylene diamine ("TAED"), pentaacetyl glucose, and ethyledine benzoate acetate.

The activator which is present at a concentration of about 0.5 to about 5.0 wt. % usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Suitable sequestering agents include the sodium salts of nitrilotriacetic acid (NTA), ethylene diamine tetraacetic acid (EDTA), diethylene triamine pentaacetic acid (DETPA), diethylene triamine pentamethylene phosphoric acid (DTPMP) sold under the tradename DEQUEST2066 and ethylene diamine tetramethylene phosphoric acid (EDITEMPA). The sequestering agents can-be used alone or in an admixture.

The detergent formulation also contains a mixture of a protease enzyme and an amylase enzyme and, optionally, a lipase enzyme that serve to attack and remove organic residues on glasses, plates, pots, pans and eating utensils. Lipolytic enzymes can also be used in the liquid automatic dishwasher detergent composition. Proteolytic enzymes remove protein residues, lipolytic enzymes fat residues and amylolytic enzymes remove starches. Proteolytic enzymes include the protease enzymes subtilisn, bromelin, papain, trypsin and pepsin. Amylolytic enzymes include alpha-amylase enzymes. Lipolytic enzymes include the lipase enzymes. The preferred amylase enzyme is available under the name Maxamyl and is available from Gist-Brocades of the Netherlands in the form of a nonaqueous slurry (18 wt. % of enzymes) having an activity of 40,000 TAu/g. The preferred protease enzyme is available under the name Maxacal derived from *Bacillus alcalophilus*, and is supplied by Gist-Brocades, of the Netherlands in a nonaqeous slurry activity of about 1,000,000 ADU/g. Preferred enzyme activities per wash are Maxacal-420-840 KDU per wash and Mazamyl-4,000–8,000 TAU per wash. Maxamyl amylase enzyme is a thermostable *B. licheniformis* alpha-amylase (39,500 TAU/g) which is supplied in a nonaqueous slurry (18 weight percent) by International BioSynthetics (Gist Brocades).

The weight ratio of the Protease enzyme to the amylolytic enzyme in the nonaqueous liquid automatic dishwasher detergent compositions is about 6:1 to about 1.1:1 more preferably about 4.5:1 to about 1.2:1.

The detergent composition can have a fairly wide ranging composition. The surfactant can comprise about 0 to 15 percent by weight of the composition, more preferably about 2 to 15 percent by weight, and most preferably about 4 to about 12 percent by weight. The soil suspending agent which is preferably a copolymerized polyacrylic acid will be present in an amount of about 0 to about 20 percent by weight, more preferably about 1 to about 10 percent by weight and most preferably about 3 to about 8 percent by weight. The antifoaming agent will be present in an amount of about 0 to about 2.5 percent by weight, more preferably about 0.1 to about 2.0 percent by weight and most preferably about 0.2 to about 1.5 percent by weight. The builder, which is preferably sodium tripolyphosphate, is present in an amount of about 10 to about 40 percent by weight, more preferably about 20 to about 38 percent by weight and most preferably about 20 to about 35 percent by weight.

The thickener, which is preferably a bentonite clay gel, is a mixture of propylene carbonate and tri-propylene glycol methyl ether (TPM) and Bentone NL 27 is preferred, it is present in an amount of about 0 to about 15 percent by weight, more preferably about 5 to about 10 percent by weight.

Other useful thickeners are fatty acid and metal fatty acid salts as described in U.S. Pat. Nos. 4,752,409 and 4,836,946, which are hereby incorporated by reference, are also useful thickeners used at a concentrate level of about 0.02 to about 5 weight percent, more preferably about 0.02 to about 3 weight percent, and most preferably about 0.05 to about 3.0 weight percent. Other useful thickeners are polycarboxylate polymers such as Carbopol polymers manufactured by B. F. Goodrich at concentration levels of about 0.1 to about 5.0 weight percent and more preferably about 0.1 to about 3.0 weight percent. Low molecular weight polyacrylate polymers such as Sokolan TM CP45, Acusol TM 460ND, Alcospere 124D and Acrysol TM 45ND are useful as thickeners at concentration levels of about 0.1 to about 10.0 weight percent, and more preferably at about 0.1 to about 5.0 weight percent.

The alkali silicate, of which sodium metro silicate is preferred, will be present in an amount of about 0 to 15 percent by weight, more preferably about 6 to about 12 percent by weight and most preferably about 3 to about 9 percent by weight. The opacifier pigment will be present in an amount of about 0.0 to about 1.0 percent by weight, more preferably about 0.1 to about 1.0 percent by weight and most preferably about 0.5 percent by weight.

The enzymes will be present in slurry form (18% enzyme in polyethylene glycol 400) in an amount of about 0.8 to 16.0 percent by weight, more preferably about 0.9 to 14.0 percent by weight, and most preferably about 1.0 to about 12.0 percent by weight. The Maxacal protease in the automatic dishwashing enzyme composition will comprise about 0.5 to about 8.0 percent by weight more preferably about 0.7 to 6.0 weight percent and most preferably about 0.8 to about 5.0 percent by weight. The amylase enzyme will comprise about 0.3 to about 6.0 percent by weight, more preferably about 0.4 to about 3.0 weight percent and most preferably about 0.5 to about 2.0 weight percent. The lipase enzyme will comprise about 0.00 to about 8.0 percent by weight of the detergent composition. Other components such as color and perfumes will be comprised of about 0.1 to about 1.0 percent by weight of the detergent composition. Another suitable lipase is Lipolase 30T from Novo Corporation. Another useful lipase enzyme is Amanu PS lipase provided by Amunco International Enzyme Co, Inc. The lipase enzymes are especially beneficial in reducing grease residues and related filming problems on glasses and dishware. The remainder of the detergent composition will be comprised of the nonaqueous carrier. This will range from about 15 to about 65 weight percent, more preferably about 25 to 57 weight percent, and most preferably about 40 to about 55 weight percent.

The detergent formulation is produced by combining the liquid components consisting of the carrier, surfactant and anti-foam agent and then adding the builder salt (TPP), the anti-redeposition agent (copolymerized polyacrylic acid) and alkali metal silicate. This mixture is then ground in a ball mill (Attritor or Netzsch) to a particle size of less than about 40 microns, and preferably to a size of about 4 to 5 microns. The enzyme mixture is then added. The enzymes preferably will be in a polyethylene glycol slurry. This enzyme mixture-is mixed into the ground slurry. Then the thickener, thickener swelling agents, opacifiers, brighteners, stabilizing agents and perfumes are added. After a thorough mixing, the detergent composition is packaged.

The concentrated nonaqueous liquid nonionic automatic dishwashing detergent compositions of the present invention disperses readily in the water in the dishwashing machine. The presently used home dishwashing machines have a measured capacity for about 80cc or 90 grams of detergent. In normal use, for example, for a full load of dirty dishes 60 grams of powdered detergent are normally used.

In accordance with the present invention only about 20cc to about 35 cc or 40 grams or less of the concentrated liquid nonionic detergent composition is needed, and more preferably 20cc or 25 grams of concentrated liquid is used per dispenser cup. The normal operation of an automatic dishwashing machine can involve the following steps or cycles: washing, rinse cycles with hot water. The entire wash and rinse cycles require about 120 minutes. The temperature of the wash water is about 100° F. to about 140° F. and the temperature of the rinse water is about 100° F. to about 140° F. The wash and rinse cycles use about 8 to 12 liters of water for the wash cycle and about 8 to 12 liters of water of the rinse cycle.

The highly concentrated nonaqueous liquid automatic dishwashing detergent compositions exhibit excellent cleaning properties of proteinaceous soils such as egg and starchy carbohydrates such as oatmeal and minimizes the formation of spots and films on the dishware and glasses.

In an embodiment of the invention the stability of the builder salts in the composition during storage and the dispersibility of the composition in water is improved by grinding and reducing the particle size of the solid builders to less than 100 microns, preferably less than 40 microns and more preferably to less than about 10 microns. The solid builders are generally supplied in particle sizes of about 100, 200 or 400 microns. The nonionic liquid surfactant phase can be possibly mixed with the solid builders prior to carrying out the grinding operation.

In the grinding operation it is preferred that the proportion of solid ingredients be high enough (e.g. at least about 40%, such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements give very good results. For larger scale work a continuously operating mill in which there are 1nm. or 1.5 mm diameter grinding balls working in a very small gap between a stator and a rotor operating at a relatively high speed e.g. a CoBall mill or a Netzsch ball mill may be employed; when using such a mill, it is desirable to pass the blend of nonionic surfactant and solids first through a mill which does not effect such fine grinding (e.g. to about 40 microns) prior to the step of grinding to an average particle diameter below about 10 microns in-the continuous ball mill It is also contemplated within the scope of this invention to form compositions without grinding, wherein he particle size has a distribution of about 60–120 microns. In a preferred embodiment the detergent builder particles have a particle size distribution such that no more than 10% by weight of said particles have a particle size of more than about 10 microns.

DESCRIPTION OF THE PREFERRED EMBODIMENTS

Example 1

The concentrated nonaqueous liquid dishwasher detergent compositions were formulated from the following ingredients in the amounts specified.

| Ingredients | Comparison A | B | C | D | E |
|---|---|---|---|---|---|
| Propylene Glycol | Balance | Balance | Balance | Balance | Balance |
| Tergitol MDS 42 Surfactant | 5.0 | 5.0 | 5.0 | 5.0 | 5.0 |
| Sodium Meta Silicate | 12.0 | 12.0 | 12.0 | 12.0 | 12.0 |
| Sodium Tripolyphosphate Anhy. | 35.00 | 35.00 | 20.00 | 20.00 | 20.00 |

-continued

| Ingredients | Comparison A | B | C | D | E |
|---|---|---|---|---|---|
| Alcospere 124D | 12.00 | 12.00 | 12.0 | 12.0 | 12.0 |
| Maxamyl Amylase COCX-5000 | 1.2 | 1.2 | 1.2 | 1.2 | 1.2 |
| Maxacal P400,000 | 2.4 | 2.4 | 2.4 | 2.4 | 2.4 |
| Lipolase 309 | 0 | 2.0 | 0 | 1.5 | 3.0 |

Laboratory Cleaning Performance

Laboratory performance of the compositions of Example were carried out using multi-soils. Egg soil was prepared by mixing egg yolk with an amount of 2.5N calcium chloride solution. 0.4 grams of this mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. 3 grams of this mixture was spread as thin film onto a 7.5 inch china plate. The plates were aged for 2 hours at 80° C. (176° F.). They were then stored overnight at room temperature. Two plates, of each egg and oatmeal were used per wash. The plates were placed in the same positions in the dishwasher, 25 grams of the detergent was used as a single dose per wash. All plates were scored by measuring the percent area cleaned. The multi-soil cleaning test results are reported as follows:

| | A | B | C | D | E |
|---|---|---|---|---|---|
| % Egg Removal | 76 | 70 | 25 | 49 | 71 |
| % Oatmeal Removal | 96 | 80 | 100 | 100 | 100 |
| Spotting | 1.0 | 1.0 | 1.0 | 1.0 | 1.0 |
| Filming | 4.5 | 1.5 | 3.0 | 2.0 | 2.0 |

The presence of lipase enzymes improves dramatically the film rating.

What is claimed is:

1. A liquid dishwashing composition which comprises in percent by weight:

| | |
|---|---|
| stabilizer | 0–7.0% |
| alkali metal silicate | 3.0–15.0% |
| liquid nonionic surfactant | 2.0–12.0% |
| alkali metal phosphate | 20.0–40.0% |
| anti-foaming agent | 0.2–1.5% |
| Maxacal protease enzyme | 0.5–12.0% |
| Maxamyl amylase enzyme | 0.3–6.0% |
| nonaqueous liquid carrier material | 25.0–45.0%, |

said liquid carrier selected from the group consisting essentially of glycols, polyglycols, polyoxides and glycol ethers and mixtures thereof, wherein said composition has less than 6.0 wt. percent of non chemically bonded water and a 1.0 wt. percent aqueous solution of said composition has a pH of less than 10.5.

2. The liquid dishwashing composition according to claim 1, wherein a weight ratio of said protease enzyme to said amylase enzyme is about 6:1 to about 1.1:1.

3. The concentrated liquid dishwashing composition according to claim 2 which includes about 0 to 8.0 weight percent of a lipase enzyme.

4. The liquid dishwashing composition according to claim 1 which contains an alkali metal perborate.

5. The liquid dishwashing composition according to claim 4 which contains an alkali metal perborate activator.

6. The composition according to claim 1, further including 0.1 to 10.0 percent of a thickening agent.

* * * * *